US008162289B2

(12) United States Patent
McCaleb

(10) Patent No.: US 8,162,289 B2
(45) Date of Patent: Apr. 24, 2012

(54) MODULAR JACK APPARATUS FOR LIFTING FLOORS AND OTHER STRUCTURES

(76) Inventor: Howard L. McCaleb, Gallatin, TN (US)

( * ) Notice: Subject to any disclaimer, the term of this patent is extended or adjusted under 35 U.S.C. 154(b) by 995 days.

(21) Appl. No.: 12/156,533

(22) Filed: Jun. 2, 2008

(65) Prior Publication Data

US 2008/0308777 A1 Dec. 18, 2008

Related U.S. Application Data

(60) Provisional application No. 60/934,706, filed on Jun. 15, 2007.

(51) Int. Cl.

| | |
|---|---|
| ***B66F 3/08*** | (2006.01) |
| ***B66F 3/24*** | (2006.01) |
| ***A62B 3/00*** | (2006.01) |
| ***E21D 15/44*** | (2006.01) |
| ***E04G 25/00*** | (2006.01) |
| ***E04G 1/22*** | (2006.01) |
| ***F16M 13/00*** | (2006.01) |

(52) U.S. Cl. ..... 254/98; 254/93 R; 254/100; 254/103; 254/2 B; 254/7 B; 248/357; 52/126.7

(58) Field of Classification Search ..... 254/98, 254/93 R, 100, 103, 2 B, 7 B, 126.7; 52/126.7
See application file for complete search history.

(56) References Cited

U.S. PATENT DOCUMENTS

| | | | | | |
|---|---|---|---|---|---|
| 1,514,262 | A | * | 11/1924 | Santmyer | 254/98 |
| 1,565,805 | A | * | 12/1925 | Jones | 254/98 |
| 3,329,402 | A | * | 7/1967 | Grumman | 254/420 |
| 3,399,866 | A | * | 9/1968 | Grumman | 254/101 |
| 3,493,209 | A | * | 2/1970 | Brammer | 248/352 |
| 4,141,526 | A | * | 2/1979 | John | 248/352 |
| 4,404,780 | A | * | 9/1983 | Josephson | 52/126.7 |
| 5,165,665 | A | * | 11/1992 | Jolivette, Sr. | 254/98 |
| 5,297,779 | A | * | 3/1994 | Collins et al. | 254/98 |
| 7,207,548 | B1 | * | 4/2007 | Howe | 254/98 |

* cited by examiner

*Primary Examiner* — Lee D Wilson
*Assistant Examiner* — Alvin Grant
(74) *Attorney, Agent, or Firm* — Michael L. McKee

(57) ABSTRACT

An apparatus which is positionable between a structure to be lifted and an underlying support surface for lifting the structure utilizes a bottom plate and a cap between which a spacer member, such as a piece of tubing, is positionable and a threaded rod which is threadably received by an internally-threaded opening in the cap. By rotating the threaded rod within the cap, the threaded rod moves lengthwise relative to the cap. Therefore, by positioning the apparatus between a structure to be lifted and an underlying support surface and then rotating the threaded rod within the cap, the bottom plate and the threaded rod act between the structure to be lifted and the underlying support surface to lift the structure.

17 Claims, 5 Drawing Sheets

MODULAR JACK APPARATUS FOR LIFTING FLOORS AND OTHER STRUCTURES

The benefit of Provisional Application Ser. No. 60/934,706, filed Jun. 15, 2007 and entitled APPARATUS FOR LIFTING FLOORS AND OTHER STRUCTURES, is hereby claimed. The disclosure of this referenced provisional patent application is incorporated herein by reference.

BACKGROUND OF THE INVENTION

This invention relates generally to means and methods for lifting and supporting structures, such as a sagging floor or roof, and relates, more particularly, to an improved apparatus, or system, which acts between the structure to be lifted and an underlying support surface for lifting the structure to a desired elevation above the underlying support surface.

It is an object of the present invention to provide a new and improved apparatus which can be used to lift and support structures, such as a floor or roof, to an elevated condition.

Another object of the present invention is to provide such an apparatus which is small enough to be readily hidden from view as it is used to support a structure and can be disassembled into a relatively compact arrangement.

Still another object of the present invention is to provide such an apparatus which is adapted to act between the structure to be raised and an underlying support surface.

Yet another object of the present invention is to provide such an apparatus which is uncomplicated in structure yet effective in operation.

SUMMARY OF THE INVENTION

This invention resides in an apparatus which is positionable between a structure to be lifted and an underlying support surface for lifting the structure.

The apparatus includes a base which is adapted to act against the underlying support surface during a lifting operation performed with the apparatus and means associated with the base defining a threaded opening whose longitudinal axis is oriented substantially normal to the underlying support surface. The apparatus further includes a threaded rod which is threadably received by the threaded opening and which has an extending end which extends out of the threaded opening for acting against the structure desired to be lifted with the apparatus so that by positioning the apparatus between the underlying support surface and the structure desired to be lifted so that the base is permitted to act against the underlying support surface and the extending end of the threaded rod is directed toward the structure desired to be lifted and subsequently rotating the threaded rod within the threaded opening so that the threaded rod moves axially therealong, the base and the threaded rod act between the structure to be lifted and the underlying support surface to lift the structure.

DETAILED DESCRIPTION OF AN ILLUSTRATIVE EMBODIMENT

Figure 1:
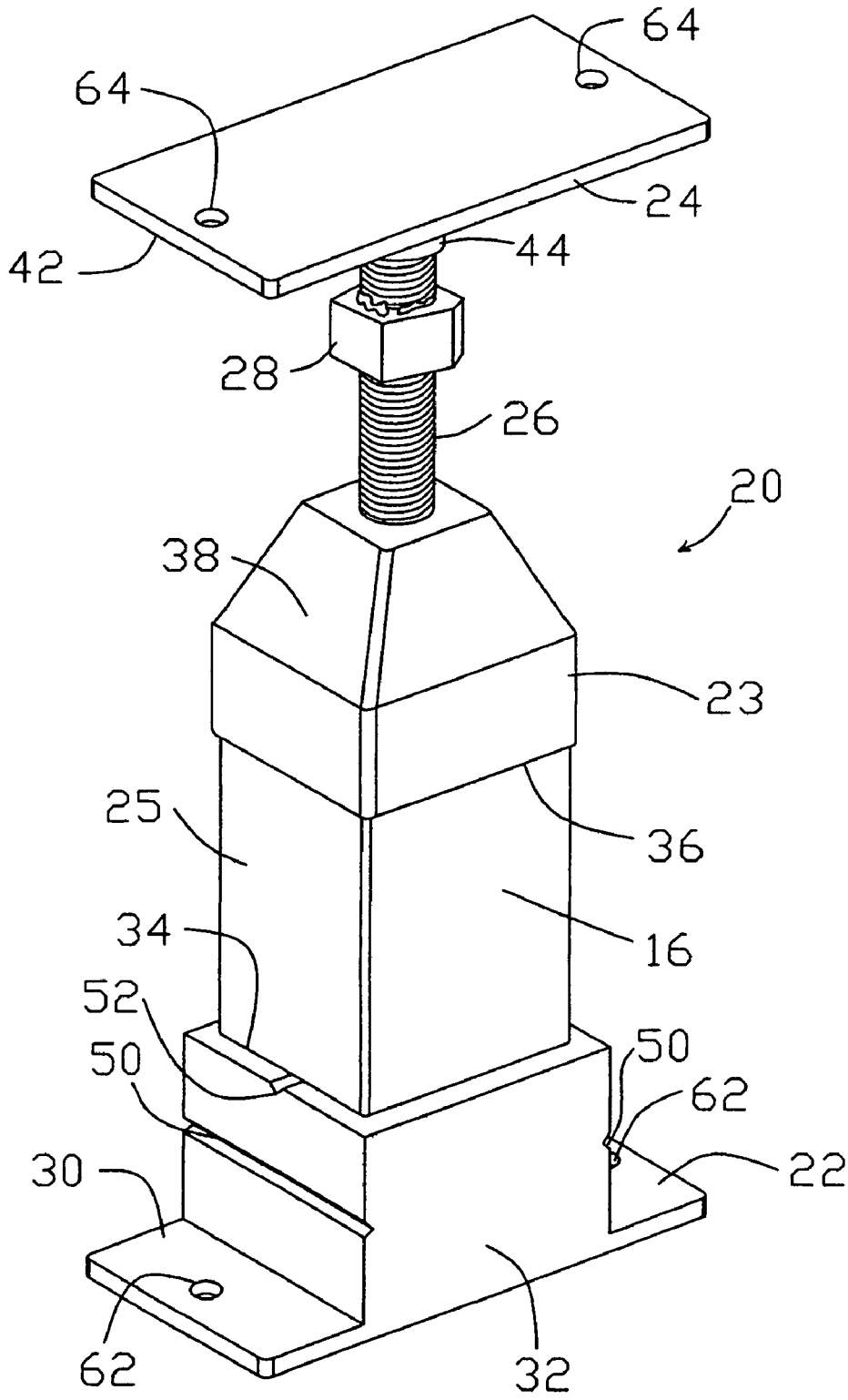
FIG. 1 is a perspective view of an embodiment of a lifting apparatus within which features of the present invention are incorporated.
Figure 2:
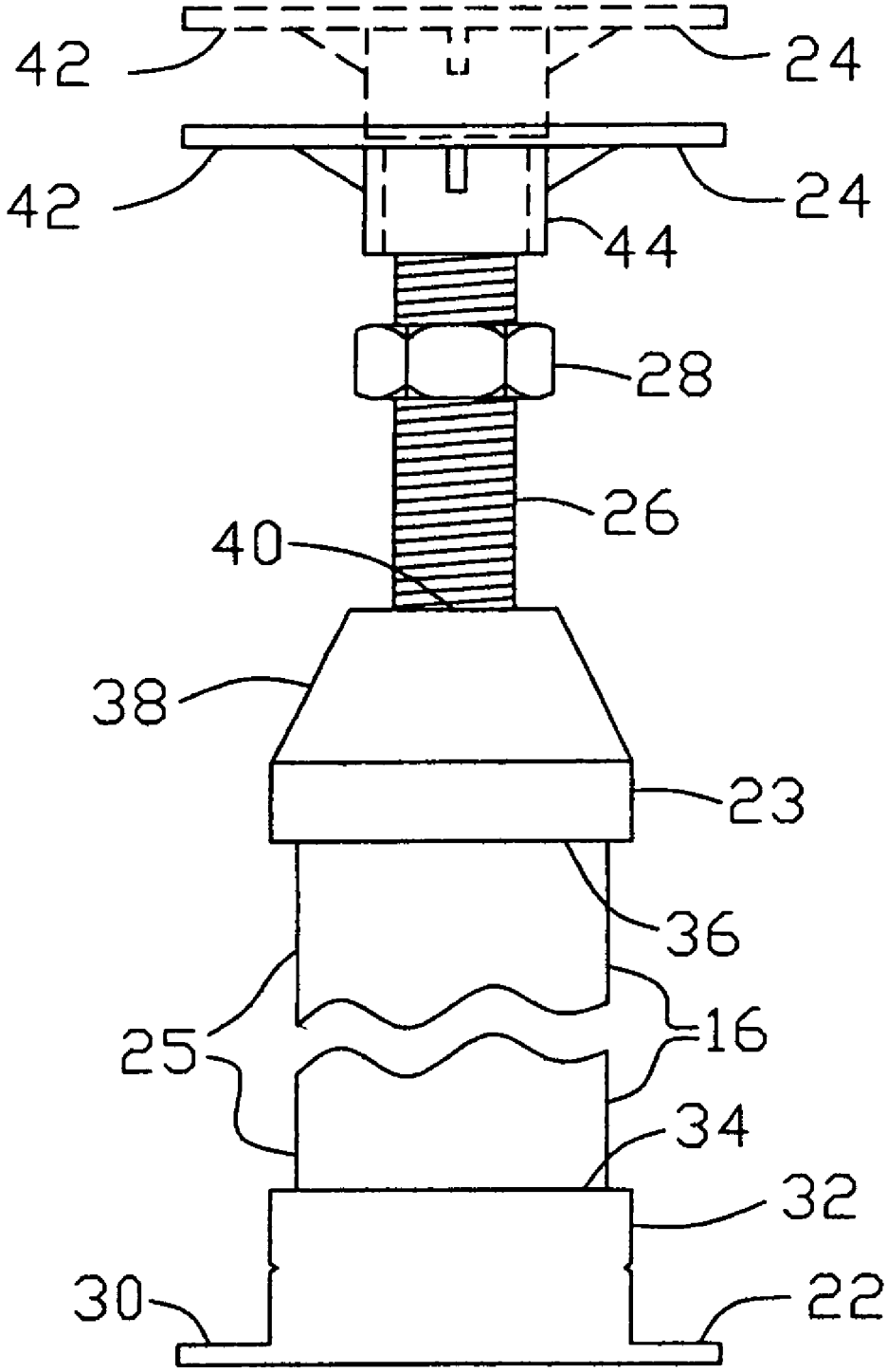
FIG. 2 is a side elevational view of the FIG. 1 embodiment.
Figure 3:
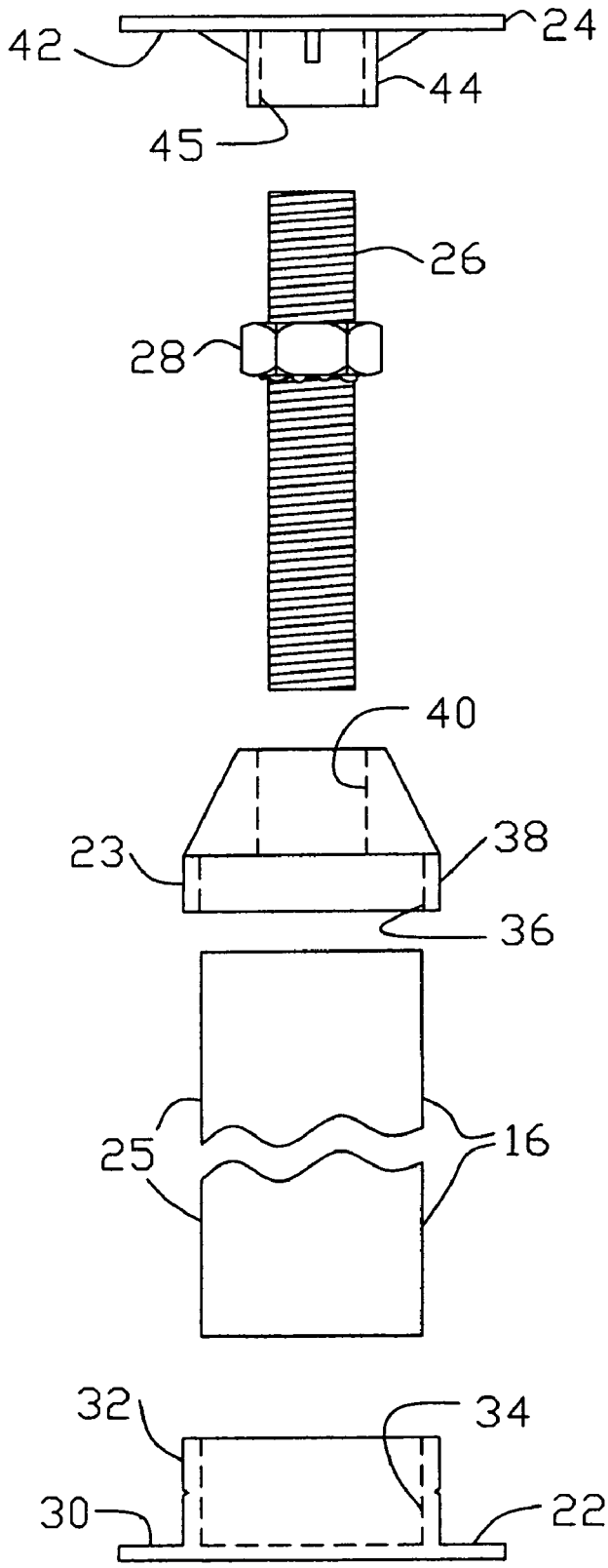
FIG. 3 is a view of the FIG. 1 embodiment similar to that of FIG. 2, but shown exploded.

Turning now to the drawings in greater detail and considering first FIGS. 1-3, there is illustrated an embodiment, generally indicated 20, of a lifting apparatus, or system, within which features of the present invention are embodied and which can be used to lift any of a number of structural items, such as a sagging floor or roof, and thereafter support the item at a desired elevation. The apparatus 20 includes a base 22 and a cap 23 between which is positioned a spacer member 16 which, in this example, is in the form of a piece 25 of square tubing. The apparatus 20 further includes a top plate 24, a threaded rod 26 and a nut 28 which is secured upon (i.e. welded to) the threaded rod 26 so that by rotating the nut 28, the rod 26 is forced to rotate, as well.

Figure 4:
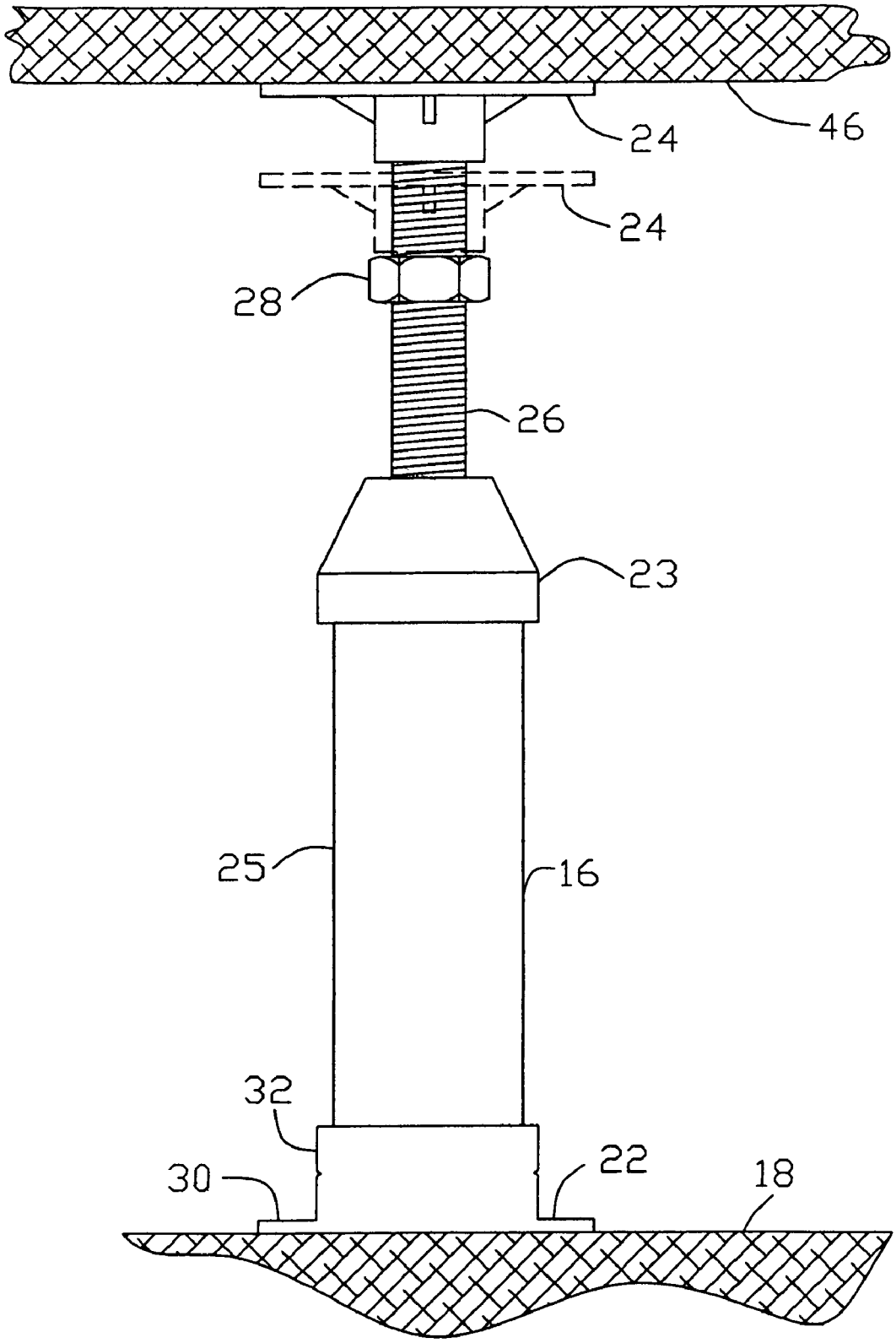
FIG. 4 is a side elevational view of the FIG. 1 embodiment shown being used to lift and support a structure above an underlying support surface.

The base 22 includes a plate portion 30 which is adapted to rest upon a support surface, indicated 18 in FIG. 4, against which one end of the apparatus 20 (i.e. the lower end thereof as viewed in FIGS. 1-3) is desired to act and a relatively deep tube-accepting portion 32 which is joined to one side of the plate portion 30. Preferably, the depth of the tube-accepting portion 32 is at least about 2.0 inches. Within the depicted base 22, the tube-accepting portion 32 includes a substantially square recess 34 which opens upwardly as viewed in FIGS. 1-3 for nestingly accepting one end, or the lower end as viewed in FIGS. 1-3, of the piece 25 of square tubing directed endwise therein. To enable the base 22 to be secured in place against the support surface 18, the plate portion 30 defines two through-openings 31 adjacent the opposite ends thereof for accepting the shanks of fasteners (not shown), such a nails or screws, used for securing the plate portion 30 against the support surface 18.

The cap 23 includes a relatively thick body 38 which provides a relatively deep, substantially square recess 36 which opens downwardly as viewed in FIGS. 1-3 and which is adapted to nestingly accept the opposite, or upper end as viewed in FIGS. 1-3, of the piece 25 of square tubing directed endwise therein. Preferably, the square recess 36 possesses a depth of at least about 1.0 inches. In addition, the body 38 of the cap 23 defines a central, internally-threaded opening 40 which opens axially along the apparatus 22 for threadably accepting one end, or the lower end portion as viewed in FIGS. 1-3, of the threaded rod 26.

To assemble the base 22, the square tubing piece 25 and cap 23, the base 22 is arranged, for example, so that the square recess 34 defined by the body thereof opens upwardly (as viewed in FIG. 3), and then one end of the square tubing piece 25 is directed downwardly into the square recess 34 until the inserted end abuttingly engages the upper surface of the plate portion 30. The square recess 40 of the cap 23 is then directed downwardly onto the upper end of the square tubing piece 25. As will be apparent herein, the apparatus 20 is compressed axially during use. Consequently and during use of the apparatus 20, the components 22, 25 and 23 need not be affixed to one another to hold these components 22, 25 and 23 in an assembled condition.

The threaded rod 26 possesses a relatively large diameter and a length which is sufficient to permit the apparatus 20 to lift a structural item through a desired distance. Furthermore, the nut 28 is secured along the length of the rod 26 at a position therealong which, in the example herein, is about one inch from the upper end of the rod 26 as depicted in FIG. 3.

The top plate 24 includes a plate portion 42 against which the (upper end of the) apparatus 20 is desired to act and a sleeve portion 44 having a relatively deep circular recess 45 (which opens downwardly as viewed in FIG. 3) for accepting the other end, or the upper end as viewed in FIGS. 1-3, of the threaded rod 26. Preferably, the recess 45 has a depth of at least about 1.0 inches. During use of the apparatus 20, the threaded rod 26 is rotated within the threaded opening 40 of the cap 23 by rotating the nut 28 with a wrench (not shown) so that the threaded rod 26 is moved upwardly or downwardly with respect to the cap 23 so that the top plate 24 (which the upper end of the threaded rod 26 contacts and bears against) is raised or lowered by a corresponding amount.

With reference to FIG. 4 and to utilize the apparatus 20 to lift an item, such as a floor 46, above an underlying support surface 18 (e.g. a concrete slab), the distance is measured between the floor 46 and the underlying support surface 18, and a piece 25 of square tubing is cut to a length which is slightly shorter (e.g. about four inches) less than the measured distance. One end of the piece 25 of tubing is then positioned within the recess 34 of the base 22, and the other end of the piece 25 of tubing is positioned within the recess 36 of the cap 23. The threaded rod 26 is threaded downwardly within the cap 23 so that the nut 28 is disposed adjacent the upper surface of the cap 23, and the top plate 24 is positioned upon the upper end of the threaded rod 26 so that the top plate 24 is arranged in about its FIG. 4 phantom-line position, the apparatus 20 is manipulated between the floor 46 to be raised and the underlying support surface 18 so that the base 22 is positioned plate-side down against the surface 18 of the underlying support and the upper surface of the top plate 24 faces upwardly toward the underside of (e.g. a joist) of the floor 46.

With the apparatus 20 arranged against between the floor 46 and the underlying support surface 18 as aforedescribed, the nut 28 is thereafter rotated with a wrench (not shown) to rotate the threaded rod 26 relative to and within the cap 23 that the upper end of the threaded rod 26 moves upwardly and forces the top plate 24 against the underside of the floor 46. It follows that as the threaded rod 26 moves upwardly relative to the cap 23, the upper end of the rod 26 bears against the underside of the plate portion 42 of the top plate 24 so that the floor 46 to be raised is lifted by a corresponding amount.

Among the advantages provided by the apparatus 20, it eliminates the need for pony wall supports in modular or site-built construction. Furthermore, it has been found that (depending upon the length of the piece 25 of tubing being used), the apparatus 20 accommodates adjustments in height of the structure to be raised from between six inches and twenty-four feet. In addition, the piece 25 of tubing can be cut to a desired length either at a jobsite or pre-cut at a shop. Still further, the apparatus 20 is ideal for use in basements, is small enough to be hidden in walls whose studs measure two by four inches, and can be disassembled into a relatively compact unit for storage or shipment.

Each piece of the apparatus 20 is comprised of state-of-the-art materials of sufficient strength to support relatively heavy loads (e.g. up to 60,000 pounds) and preferably are of cast steel construction which has been treated, or coated, with a zinc dichromate to resist rust or corrosion—even in salt air environments. The tubing out of which the piece 25 is constructed can be of any of a number of tubing grades (such as IE ⅜ inch or ¼ inch) and possess any of a number of cross-sectional sizes, such as the common sizes of 2.5 inch, 3.0 inch, 4.0 inch, 6.0 inch or 8.0 inch square steel tubing.

To date, the apparatus 20 has been constructed with bottom and plates 22, 24 which nestingly accept 2.5 square tubing, 3 inch square tubing, 4 inch square tubing, 6 inch square tubing or 8 inch square tubing. Furthermore, square tubing pieces available for use as the piece 25 can possess any of a number of wall thicknesses, such as 3/16 inch or ¼ inch. Furthermore, the recesses of the base 22 and the cap 23 can be formed to accommodate either square or round pilings constructed of either wood or concrete, and the relatively narrow profile of the apparatus 20 (when, for example, the apparatus components are sized to accommodate a piece 25 of 2.5 inch square tubing) enables the apparatus 20 to fit within, or inside, walls employing standard 2 inch by 4 inch studs. Once installed, the apparatus 20 provides up to about 4.0 inches of height adjustment.

By way of example, each of the plate portions of the base and top plates 22, 24 measures 3 and ¼ inches in width by six inches in length, but the bottom plate 30 and top plate 24 can possess sizes which are different from one another. Furthermore, each of the bottom and top plates can be provided with preformed openings 62 or 64, respectively (FIG. 1) to accommodate the insertion of lag bolts therethrough. In the depicted FIG. 1 embodiment 20, the preformed openings 64 provided in the top plate 24 accommodate the insertion of ⅜ inch by 1 and ½ inch lag bolts while the preformed openings 62 provided in the bottom plate 30 accommodate the insertion of ⅜ inch anchors. In addition, the threaded rod 26 can possess a diameter of about ⅞ inches and a length of about 6 inches. A threaded rod 26 comprised of heavy-duty cast steel components and a 1.0 inch diameter, Grade 5 material has been successfully tested to withstand a weight of up to 60,000 pounds.

Further still, the recess-defining body of the base 22 is provided with a pair of horizontal linear grooves 50 on opposite sides of the recess 34 to facilitate the leveling of the plates 22 when embedded (if desired) in concrete, and a pair of notches 52 are provided on opposite sides of the recess 34 to provide a guide which facilitates the plumbing (i.e. the vertical alignment) of the top and bottom plates 24, 22.

In addition, the apparatus 20 can be used in a wide variety of applications involving the need for lifting and supporting a structure above an overlying support. Such applications include, but are not limited to, use as basement supports, use as center-wall supports in modular homes, use in load bearing walls in site-built homes, use as beam supports, use in load bearing units between garage doors, and use in deck supports and as leveling units.

It will be understood that numerous modifications and substitutions can be had to the aforedescribed embodiment without departing from the spirit of the invention. For example, although some of the apparatus components, such as the base 22 or top plate 24, have been shown as including spaced-apart openings for securement of the components to an underlying support or to an item to be lifted, the components can include alternative aids for securing the components to the surfaces or items against which the apparatus is intended to act. For example, an apparatus in accordance with the broader aspects of the invention can include a base whose plate portion defines a centrally-disposed opening for accepting an anchoring fastener for anchoring the base within a concrete slab. Of course, the shape of some such anchoring fasteners requires that they be embedded within such a slab of concrete before the concrete is permitted to cure to a hardened condition.

Figure 5:
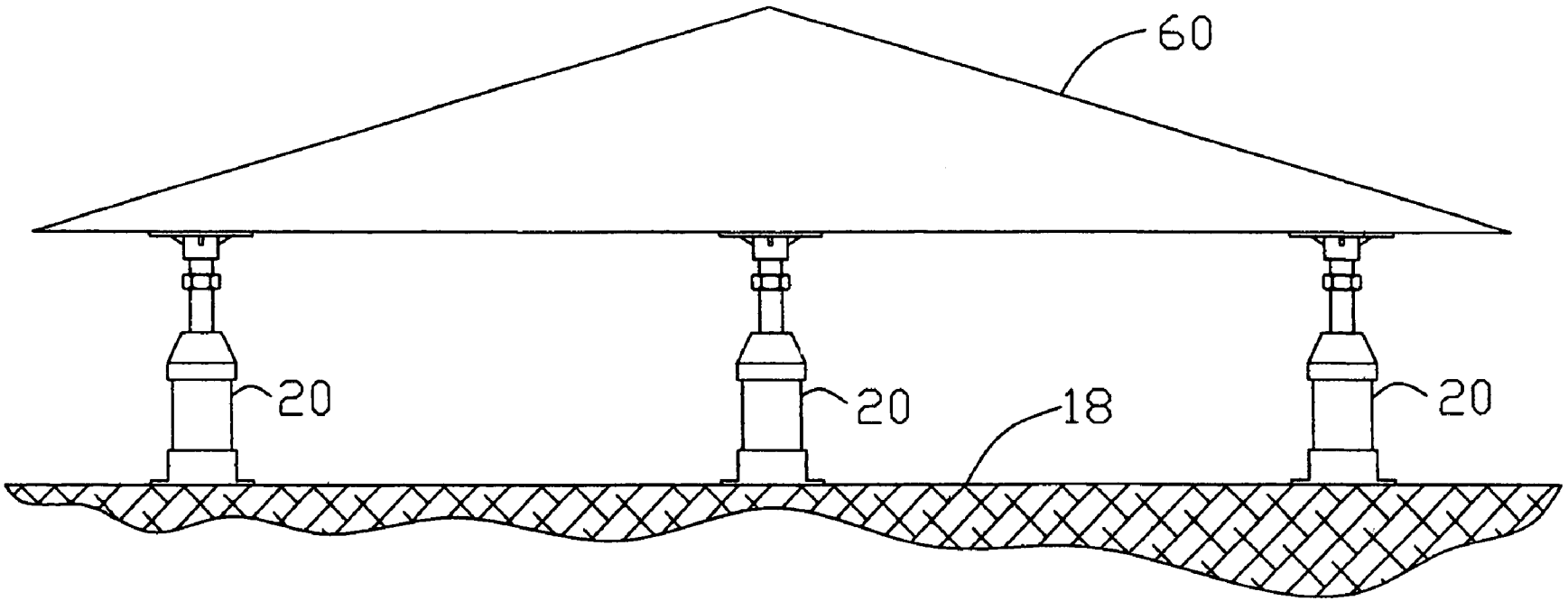
FIG. 5 is a side elevational view of a plurality of identified lifting apparatus being used in a single application.

Further still, although the aforedescribed embodiment 20 has been shown and described as being used by itself for lifting and supporting a structure, the apparatus 20 can be used with lifting apparatus of like construction to support a structure. For example, there is illustrated in FIG. 5 an application in which three apparatus 20 are used to support a structure, such as a wall 60 above an underlying support surface 18. In the FIG. 5 application, each apparatus 20 is spaced from its nearest apparatus 20 by a distance of about eight feet. Accordingly, the aforedescribed embodiment is intended for the purpose of illustration and not as limitation.

The invention claimed is:

1. An apparatus for use with an elongated spacer member having two opposite ends for lifting a structure above an underlying support surface, the apparatus comprising:

a base which is adapted to act against the underlying support surface during a lifting operation performed with the apparatus and which defines an upwardly-opening recess which is sized to nestingly accept one end of the two opposite ends of the elongated spacer member inserted endwise therein;

a cap associated with the base defining a threaded opening whose longitudinal axis is oriented substantially normal to the underlying support surface and which defines a downwardly-opening recess which is sized to nestingly accept the other end of the two opposite ends of the elongated spacer member inserted endwise therein; and a threaded rod which is threadably received by the threaded opening and which has an extending end which extends out of the threaded opening for acting against the structure desired to be lifted with the apparatus so that by inserting one end of the two opposite ends of the elongated spacer endwise into the upwardly-opening recess of the base and inserting the other end of the two opposite ends of the elongated spacer member endwise into the downwardly-opening recess of the cap and then positioning the apparatus between the underlying support surface and the structure desired to be lifted so that the base is permitted to act against the underlying support surface and the extending end of the threaded rod is directed toward the structure desired to be lifted and subsequently rotating the threaded rod within the threaded opening so that the threaded rod moves axially therealong, the base, the spacer member, the cap and the threaded rod act between the structure to be lifted and the underlying support surface to lift the structure, and so that by selecting a spacer member of appropriate length, the apparatus can be used to lift a structure above an underlying support surface, no matter the height between the structure and the underlying support surface.

2. The apparatus as defined in claim 1 further comprising a nut-like member which is fixedly secured along the length of the threaded rod to enable the threaded rod to be rotated within the threaded rod with a wrench.

3. The apparatus as defined in claim 2 wherein the threaded rod has an extending portion which extends from the threaded opening and defines the extending end of the rod, and the nut-like member is fixedly secured along the length of the extending portion of the threaded rod.

4. The apparatus as defined in claim 1 wherein each end of the two opposite ends of the spacer member has a cross-sectional shape, and each of the upwardly-opening recess of the base and the downwardly-opening recess of the cap has a cross-sectional shape which corresponds to the cross-sectional shape of the end of the spacer member accepted by the upwardly-opening recess of the base or the downwardly-opening recess of the cap.

5. The apparatus as defined in claim 4 wherein the cross-sectional shape of each of the upwardly-opening recess of the base and the downwardly-opening recess of the cap is substantially square.

6. The apparatus as defined in claim 1 further including a top plate which is positionable against the support structure desired to be lifted by the apparatus, and the top plate defines a surface against which the extending end of the threaded rod is adapted to act so that during a lifting operation performed with the apparatus, the top plate is positioned between the extending end of the threaded rod and the support structure.

7. The apparatus as defined in claim 6 wherein the top plate includes a body which defines a recess for accepting the extending end of the threaded rod when positioned therein and the recess has a bottom surface which provides the surface against which the extending end of the threaded rod is adapted to act.

8. An apparatus which is positionable between a structure to be lifted and an underlying support surface for lifting the structure, the apparatus comprising:

a base for acting against the underlying support surface during a lifting operation performed with the apparatus and which defines an upwardly-opening recess;

a cap having a body which defines an internally-threaded opening having a longitudinal axis and a downwardly-opening recess;

an elongated spacer member having two opposite ends and a longitudinal axis and which is positionable upon the base so that one end of the two opposite ends of the base is nestingly accepted by the upwardly-opening recess of the base and so that the longitudinal axis of the base is arranged substantially normal to the base, and the cap being positionable upon the spacer member so that the other end of the two opposite ends of the spacer member is nestingly accepted by the downwardly-opening recess of the cap and so that the longitudinal axis of the internally-threaded opening is coincident with the longitudinal axis of the spacer member; and a threaded rod which is threadably received by the internally-threaded opening of the cap and which has an extending end which extends out of the internally-threaded opening for acting against the structure desired to be lifted with the apparatus so that by rotating the threaded rod within the cap, the extending end of the threaded rod moves lengthwise relative to the cap so that by positioning the apparatus between a structure to be lifted and an underlying support surface so that the base is permitted to act against the underlying support surface and the extending end of the threaded rod is directed toward the structure desired to be lifted and subsequently rotating the threaded rod within the internally-threaded opening of the cap, the base and the threaded rod act between the structure to be lifted and the underlying support surface to lift the structure, and so that by selecting a spacer member of appropriate length, the apparatus can be used to lift a structure above an underlying support surface, no matter the height between the structure and the underlying support surface.

9. The apparatus as defined in claim 8 further comprising a nut-like member which is fixedly secured along the length of the threaded rod to enable the threaded rod to be rotated within the internally-threaded opening of the cap with a wrench.

10. The apparatus as defined in claim 9 wherein the threaded rod has an extending portion which extends from the internally-threaded opening and defines the extending end of the rod, and the nut-like member is fixedly secured along the length of the extending portion of the threaded rod.

11. The apparatus as defined in claim 8 wherein the base includes a plate portion which is adapted to overlie the underlying support surface when the apparatus is used to lift a structure and a body portion defining an opening therein and which is integrally joined to the plate portion so that the opening defined therein is directed away from and arranged normal to the plate portion to provide the upwardly-opening recess of the base.

12. The apparatus as defined in claim 8 wherein each end of the two opposite ends of the spacer member has a cross-sectional shape, and each of the upwardly-opening and the downwardly-opening recess of the base and the cap has a cross-sectional shape which corresponds to the cross-sectional shape of the end of the spacer member accepted by the upwardly-opening recess of the base or the downwardly-opening recess of the cap.

13. The apparatus as defined in claim 12 wherein the cross-sectional shape of each of the upwardly-opening recess of the base and the downwardly-opening recess of the cap is substantially square.

14. The apparatus as defined in claim 8 further including a top plate which is positionable against the support structure desired to be lifted by the apparatus, and the top plate defines a surface against which the extending end of the threaded rod is adapted to act so that during a lifting operation performed with the apparatus, the top plate is positioned between the extending end of the threaded rod and the support structure.

15. The apparatus as defined in claim 14 wherein the top plate includes a body which defines a first recess for nestingly accepting the extending end of the threaded rod when positioned therein and the first recess has a bottom surface which provides the surface against which the extending end of the threaded rod is adapted to act.

16. An apparatus which is positionable between a structure to be lifted and an underlying support surface for lifting the structure, the apparatus comprising:

a base for acting against the underlying support surface during a lifting operation performed with the apparatus, the base having a plate portion for overlying the underlying support surface and a body portion which is integrally joined to the plate portion and which defines an upwardly-opening recess which opens upwardly when the plate portion is positioned in overlying relationship with the underlying support surface;

a cap having a body which defines an internally-threaded opening having a longitudinal axis and further defining a downwardly-opening recess which opens downwardly when the'cap is arranged between the structure and the underlying support surface for purposes of lifting the structure;

an elongated spacer member having two opposite ends and a longitudinal axis and which is positionable upon the base so that one end of the two opposite ends of the spacer member is nestingly accepted by the upwardly-opening recess of the body of the base and the longitudinal axis of the base is arranged substantially normal to the plate portion of the base, and the cap is positionable upon the spacer member so that the other end of the two opposite ends of the spacer member is nestingly accepted by the downwardly-opening recess of the body of the cap and so that the longitudinal axis of the internally-threaded opening is coincident with the longitudinal axis of the spacer member;

a threaded rod which is threadably received by the internally-threaded opening of the cap and which has an extending end which extends out of the internally-threaded opening for acting against the structure desired to be lifted with the apparatus so that by rotating the threaded rod within the cap, the extending end of the threaded rod moves lengthwise relative to the cap so that by positioning the apparatus between a structure to be lifted and an underlying support surface so that the base is permitted to act against the underlying support surface and the extending end of the threaded rod is directed toward the structure desired to be lifted and subsequently rotating the threaded rod within the internally-threaded opening of the cap, the base and the threaded rod act between the structure to be lifted and the underlying support surface to lift the structure; and a top plate which is positionable against the support structure desired to be lifted by the apparatus, and the top plate defines a surface against which the extending end of the threaded rod is adapted to act so that during a lifting operation performed with the apparatus, the top plate is positioned between the extending end of the threaded rod and the support structure, and so that by selecting a spacer member of appropriate length, the apparatus can be used to lift a structure above an underlying support surface, no matter the height between the structure and the underlying surface.

17. The apparatus as defined in claim 16 wherein the top plate includes a body which defines a first recess for nestingly accepting the extending end of the threaded rod when positioned therein and the first recess has a bottom surface which provides the surface against which the extending end of the threaded rod is adapted to act.

* * * * *